US005677652A

United States Patent [19]

Parrott

[11] Patent Number: 5,677,652

[45] Date of Patent: Oct. 14, 1997

[54] MICROWAVE FERRITE RESONATOR WITH PARALLEL PERMANENT MAGNET BIAS

[75] Inventor: Ronald A. Parrott, Healdsburg, Calif.

[73] Assignee: Verticom, Inc., Santa Rosa, Calif.

[21] Appl. No.: 637,063

[22] Filed: Apr. 24, 1996

[51] Int. Cl.[6] ..... H01P 7/00

[52] U.S. Cl. ..... 333/219.2; 333/202

[58] Field of Search ..... 333/219.2, 202

[56] References Cited

U.S. PATENT DOCUMENTS

| | | | |
|---|---|---|---|
| 4,516,096 | 5/1985 | Doyen | 333/219.2 |
| 4,679,015 | 7/1987 | Murakami et al. | 333/219.2 |
| 4,701,729 | 10/1987 | Ito et al. | 333/219.2 |
| 4,945,324 | 7/1990 | Murakami et al. | 333/219.2 |
| 5,309,127 | 5/1994 | Mariani | 333/219.2 |
| 5,428,324 | 6/1995 | Anderson et al. | 333/219.2 |
| 5,517,161 | 5/1996 | Anderson et al. | 333/219.2 |

FOREIGN PATENT DOCUMENTS

| | | | |
|---|---|---|---|
| 3-280602 | 12/1991 | Japan | 333/219.2 |

*Primary Examiner*—Benny Lee
*Assistant Examiner*—Darius Gambino
*Attorney, Agent, or Firm*—Townsend and Townsend and Crew LLP; Kenneth R. Allen

[57] ABSTRACT

A magnetic structure for a ferrite-based electromagnetic resonator comprises a toroidal permanent magnet which surrounds high permeability material forming a gap in which there is for example a YIG sphere which is tunably resonant in a magnetic field. The high permeability material also forms part of a magnetic circuit. A main electromagnetic coil, preferably a solenoid, surrounds the permanent magnetic structure and the high permeability material, and a modulation coil, also preferably in the form of a toroid, also surrounds the gap in the magnetic circuit.

8 Claims, 2 Drawing Sheets

MICROWAVE FERRITE RESONATOR WITH PARALLEL PERMANENT MAGNET BIAS

BACKGROUND OF THE INVENTION

This invention relates to structures for high frequency fundamental resonators, particularly for frequency sources and for filters. More particularly, the invention relates to ferrite or YIG oscillators.

YIG oscillators are a favored form of fundamental electromagnetic energy generation at frequencies in the spectrum of about 1 GHz to about 100 GHz. A YIG oscillator is a yttrium iron garnet crystal which when placed in a saturating magnetic field oscillates to generate electromagnetic energy at frequencies based on the strength of the magnetic field.

In the past, magnetic circuits surrounding the YIG resonators have been designed with electromagnetic coils coupled in series with bias magnets, such as permanent magnets, where the magnets would provide biases without need for application of electromagnetic currents. One of the problems with series-type structures has been undesirable losses associated with excessive leakage flux inherent in conventional series structures. These losses have an impact on the sensitivity of the tunability of the YIG resonators.

It is desirable to reduce or otherwise control the leakage flux so it does not interfere with the electromagnetic field. Thus the flux required of the permanent magnet and the electromagnet could be reduced.

SUMMARY OF THE INVENTION

According to the invention, a magnetic structure for a ferrite-based electromagnetic resonator comprises a permanent magnet which surrounds high permeability material with faces forming a gap in which there is for example a YIG sphere which is tunably resonant in a magnetic field. The high permeability material also forms part of a magnetic circuit. A main electromagnetic coil, preferably a solenoid, surrounds the permanent magnetic structure and the high permeability material, and a modulation coil, preferably in the form of a solenoid, also surrounds the gap in the magnetic circuit. The high permeability material is shaped with opposing faces to provide a desired gap across the magnetic YIG sphere. In an alternative embodiment, a disk of a permanent magnet is additionally provided between the high permeability material and a shell formed of high permeability material which encloses the coil structures and the permanent magnet to define a magnetic circuit. A ring of ferromagnetic material may be slidably mounted along the axis of the gap to control the amount of leakage between layers of high permeability material around the magnetic gap.

The invention will be better understood by reference to the following detailed description in connection with the accompanying drawings.

DETAILED DESCRIPTION OF THE SPECIFIC EMBODIMENTS

Figure 1:
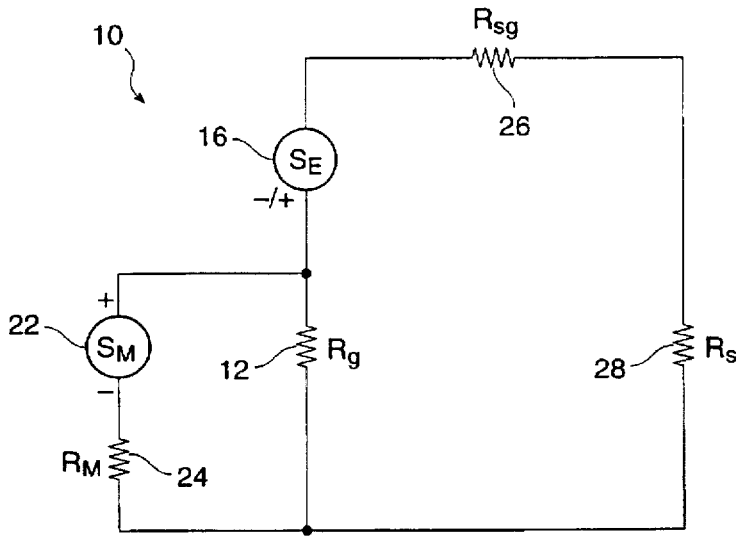
FIG. 1 is a schematic diagram of a magnetic circuit according to a first embodiment of the invention.
Figure 2:
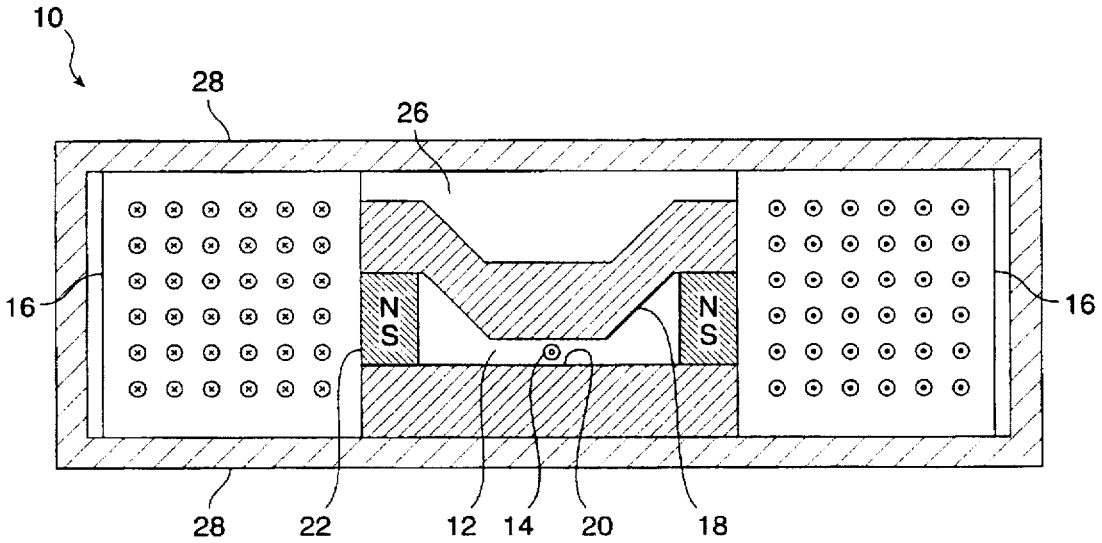
FIG. 2 is a cross-sectional diagram according to the schematic drawing of the first embodiment of the invention.

Referring to FIG. 1 and FIG. 2 together, a magnetic circuit 10 is formed around a gap 12 of reluctance $R_g$ in which a ferrite object 14, such as a YIG sphere, is placed. The purpose of the magnetic circuit 10 is to provide a high intensity controlled magnetic field between opposing faces across the gap 12. The magnetic field is created by magnetic sources. For example, a relatively large electromagnet 16 shaped in the form of a solenoid surrounds the gap and is disposed to create a flux across the gap 12. (Alternatively, more than one independent solenoid may be used. It should be appreciated that the gap is on the order of a fraction of a centimeter and the sphere is on the order of a millimeter or less in diameter. The gap itself is defined by the opposing faces of a first high permeability element 18 and a second high permeability element 20 wherein the periphery of the elements 18, 20 are in the magnetic circuit of a permanent magnet as hereinafter explained. Suitable high permeability materials are nickel-iron alloys such as Carpenter 49 (49% nickel, 51% iron), or iron. Other ferromagnetic materials can also be used as the high permeability material. The opposing faces define a working flux path across the gap 12 in which the ferrite object 14 may resonate in the presence of the controlled magnetic field.

According to the invention, a permanent magnet means 22 is disposed to bridge around the gap and to confront the first high permeability disk element 18 and simultaneously the second high permeability element 20, thereby to provide a magnetic flux path which is parallel to the working flux path. (Polarity is shown for relative value only between facing structures, and polarity may be reversed.) The permanent magnet means may be a series of posts surrounding the gap at a semicircular arrangement, or it may be a toroidal magnet with poles on its opposing faces. The permanent magnet means 22 must provide magnetization bias parallel to the working flux path. The permeability of the permanent magnet means 22 is represented by a value $R_m$ (24). This distance can be designed into the structure independent of the distance across the gap 12.

The magnetic circuit is completed by an insulating gap 26 between one of the high permeability disks 18 and a high permeability shell 28 surrounding the main magnet 16 and substantially enclosing the entire structure. The reluctance of the circuit is represented by the reluctance value $R_s$ for the shell plus $R_{sg}$ for the insulating gap 26 plus $R_g$ for the gap 12 plus $R_e$ for the electromagnet 16. Topologically, the reluctance is anywhere within the magnetic circuit.

Figure 3:
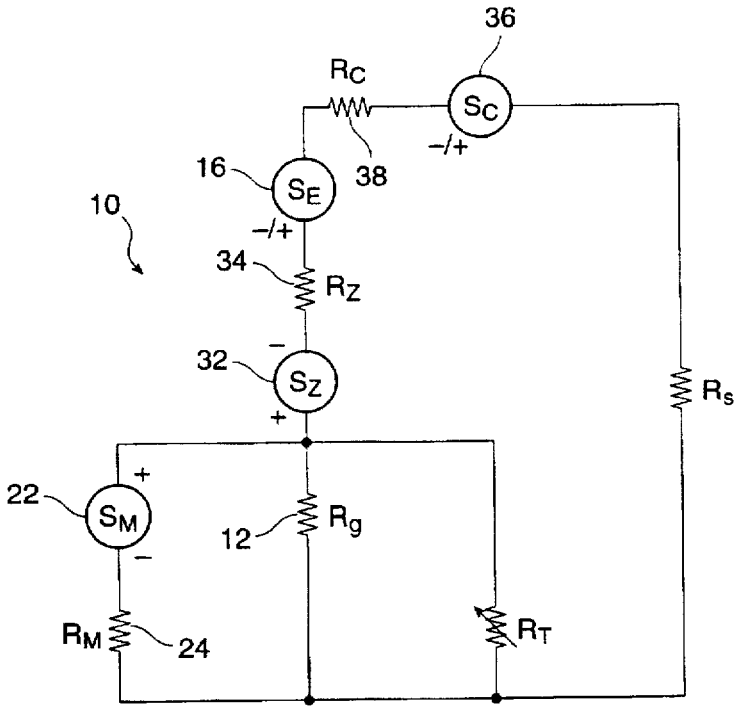
FIG. 3 is a schematic diagram of a magnetic circuit according to a second embodiment of the invention.
Figure 4:
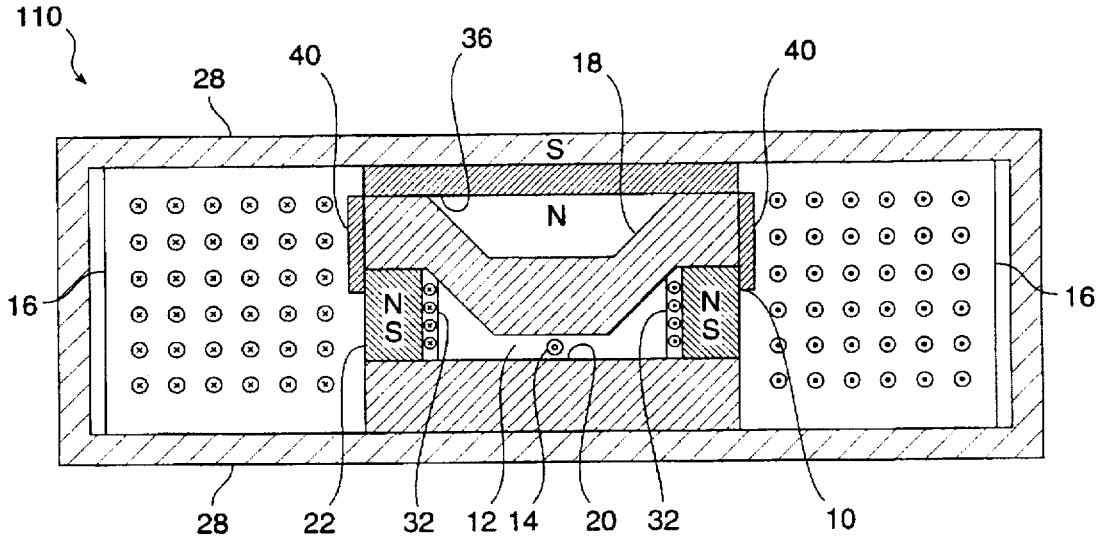
FIG. 4 is a cross-sectional diagram according to the schematic drawing of the second embodiment of the invention.

Referring to FIG. 3 in connection with FIG. 4, there is illustrated an alternative embodiment of a magnetic structure 110 according to the invention. The topology of the structure of FIG. 4 is substantially the same as the structure of FIG. 2, so the entire description need not be repeated here except to illustrate differences. In the embodiment of FIG. 3 and FIG. 4, a tuning coil 32 of source magnetism ($S_t$) and reluctance 34 ($R_t$) is included in the magnetic circuit and preferably within the enclosure formed by the permanent magnet means 22 around the gap 12. This tuning coil 32, which is preferably spirally wound, is used for fine tuning the flux in the working flux path at gap 12, which is necessary for many applications. The location and style of tuning coil is selectable.

The structure of FIG. 2 is optionally further improved, as shown in FIGS. 3 and 4, by providing a second permanent magnet 36 with source magnetism $S_c$ and reluctance $R_c$ 38 in place of the insulating gap 26. The second permanent magnet 36 is disposed with its polarity opposing the polarity of the first permanent magnet 22 and has the effect, when disposed in the magnetic circuit 110, of shielding against flux leakage from the high permeability element 20. Preferably, the second permanent magnet 36 is a disk juxtaposed to the high permeability element 20 on one of its sides and on its opposing side, juxtaposed to the shell 28 to form a continuous path in the magnetic circuit 110.

Preferably also, the first permanent magnet 22 is a toroid. Thus, the structure formed is the main electromagnet 16 as a solenoid shaped in a toroidal winding around the first permanent magnet 22, which may also be a toroid, and the tuning magnet 32 within the permanent magnet, all surrounding the gap 12 through which is a working flux path with a parallel bypass flux path through the first permanent magnet 22. The second permanent magnet 36 is a disk (optionally, with a hollow center) on one side of the gap 12 in the magnetic circuit completed by the shell 28. Various shapes and sizes are also contemplated so long as a magnetic circuit is formed which is substantially independent of the spacing across the gap.

As a still further enhancement of the invention, a collar 40 may be provided in contact with at least one of the high permeability disks 18 or 20. This toroidal collar on the outside of the disk can be positioned in parallel to the alternative flux path. Depending on positioning, it extends at least partially around the first permanent magnet 22. When the collar is constructed of a high permeability material, it mitigates the impact of the second permanent magnet 36 to permit selective flux leakage from the high permeability material disk 18. If the collar 40 is constructed of a permanent magnet, likewise with its polarity opposing that of the polarity of the first permanent magnet 22 and selectively placed concentrically around the high permeability material disks 18 or 20, it serves to enhance the impact of the second permanent magnet 22 and thus counter flux leakage.

The ferrite resonator structure as herein described overcomes the problems of placing a permanent magnet in a series magnetic circuit with the main magnet and the tuning magnet, so that the size of the gap can be controlled independently of the structural limitations on the permanent magnet. As a consequence, an extremely low-cost, high-efficiency ferrite oscillator, filter, or like resonator structure, can be constructed with the substantial advantages of a pure electromagnetic signal source having high phase stability substantially immune from microphonics. Moreover, the structure has the advantage of providing highly sensitive, extremely linear frequency tuning, with a gap-controlled working flux path which is independent of the flux path through the permanent magnet.

The invention has now been explained with respect to specific embodiments. Other embodiments will be apparent to those of ordinary skill in the art. It is therefore not intended that this invention be limited, except as indicated by the appended claims.

What is claimed is:

1. An apparatus for electromagnetically resonating a ferrite object, such as a YIG sphere, in a gap, said apparatus comprising:

a first high permeability element having a face forming a first side of said gap for confronting said ferrite object;

a second high permeability element having a face forming a second side of said gap and confronting said ferrite object in opposition to said first side, said gap defining a working flux path in which said ferrite object may resonate in the presence of a controlled magnetic field;

a first permanent magnet means, said first permanent magnet means disposed to bridge around said gap and to confront said first high permeability element thereby to define a magnetic flux path parallel to said working flux path;

a main magnet disposed between said gap and a high permeability shell forming return magnetic path for controlling magnetic fields external to said permanent magnet means and for controlling flux through said ferrite object; and said high permeability shell surrounding said main magnet in completion of a magnetic circuit through said first high permeability element and said second high permeability element and said gap.

2. The apparatus according to claim 1, further including a tuning coil disposed adjacent said permanent magnet means for fine tuning flux in said working flux path.

3. The apparatus according to claim 1, further including a second permanent magnet means disposed in said magnetic circuit to shield against flux leakage from at least one of said first high permeability element and said second high permeability element.

4. The apparatus according to claim 3 wherein said second permanent magnet means is a disk juxtaposed between said shell and one of said first high permeability element and said second high permeability element, said second permanent magnet means being disposed with polarity opposing said first permanent magnet means.

5. The apparatus according to claim 4 wherein said first permanent magnet means is a toroid.

6. The apparatus according to claim 1 wherein said first permanent magnet means has a magnetization length greater than said gap.

7. The apparatus according to claim 3, further including a collar of high permeability material in contact with at least one of said first high permeability element and said second high permeability element and extending concentrically at least partially around said first permanent magnet means to mitigate impacts of said second permanent magnet means to permit selective flux leakage.

8. The apparatus according to claim 3, further including a collar of permanent magnetic material in contact with at least one of said first high permeability element and said second high permeability element and extending concentrically at least partially around said first permanent magnet means to enhance impacts of said second permanent magnet means to counter flux leakage.

* * * * *